United States Patent [19]

Archer et al.

[11] 4,076,068

[45] Feb. 28, 1978

[54] INSULATING VENETIAN BLIND

[75] Inventors: John Neville Archer, Nynashamn; Hans Folke Larsson, Vasterhaninge, both of Sweden

[73] Assignee: Rederiaktiebolaget Nordstjernan, Stockholm, Sweden

[21] Appl. No.: 695,571

[22] Filed: Jun. 14, 1976

[51] Int. Cl.[2] ..... E06B 9/30

[52] U.S. Cl. ..... 160/107; 160/114; 160/168 R

[58] Field of Search ..... 160/107, 166–178 R, 160/114, 115; 49/61, 64, 77, 78, 86

[56] References Cited

U.S. PATENT DOCUMENTS

| | | | |
|---|---|---|---|
| 2,117,953 | 5/1938 | Grau | 160/114 |
| 2,281,071 | 4/1942 | Knudsen | 160/107 |
| 2,415,222 | 2/1947 | Spencer | 160/107 |
| 2,742,681 | 4/1956 | Goodwyn | 49/64 |
| 2,758,345 | 8/1956 | White | 49/77 |
| 2,920,694 | 1/1960 | Falotico | 160/114 |
| 2,991,697 | 7/1961 | Vetere | 49/77 |

*Primary Examiner*—Peter M. Caun

*Attorney, Agent, or Firm*—Burns, Doane, Swecker & Mathis

[57] ABSTRACT

The blind of the invention consists essentially of an arrangement of a number of thin but stiff blades, disposed between the panes of a two-pane window, which blades stretch horizontally across the whole of the window from one edge of the frame to the other and which are rotatable between mainly a vertical and a horizontal position. The invention is characterized in that in the vertical position the blades form at least substantially tight walls spaced apart and forming between them an integral and substantially closed air space.

6 Claims, 2 Drawing Figures

INSULATING VENETIAN BLIND

Figure 1:
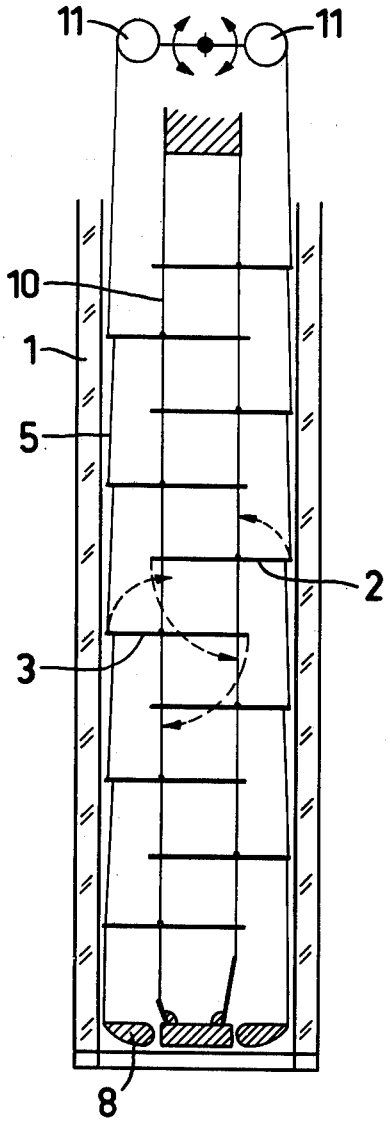

This invention relates to a venetian blind suitable for fitting inside a double glass window, which blind, in the open position, gives an almost unimpaired view through the window, and in the closed position gives a considerable heat insulation effect.

Insulating venetian blinds are already known which are of such character that they contain closed air spaces separated from each other in the vertical direction in order to prevent convection currents, thereby reducing heat loss through the blind.

A normal window with two panes of glass has a heat transmission or "*k* value" of 2.8 $W/m^{2\circ}$ C, which means that a considerable quantity of heat passes through such a window. An energy report has therefore recently suggested that windows with two panes of glass should be changed to three panes of glass thereby reducing the *k* value to 1.7 $W/m^{2\circ}$ C. However, it has not been considered that existing heat insulating venetian blinds were worth recommending because their insulating properties have not been shown to be sufficient. The reason for this is as follows: The venetian blinds constructed as described above all allow a heat loss by conduction from the blinds' inner face to its outer face, that is, a heat bridge. It can be added that venetian blinds are almost always made of aluminum to ensure stiffness which results in the heat bridge being a good conductor.

According to the present invention the venetian blind shall form an integral closed air space between its inner and outer surface without the presence of the above-mentioned heat bridge. It has been shown that a venetian blind made of aluminum according to the invention has a *k* value less than 1.7 $W/m^{2\circ}$ C quoted for a window with three panes of glass. Thereby one is offered the opportunity for heat insulation which is decidedly cheaper than a window with three panes of glass.

The blind of the present invention consists essentially of a number of thin blades, which are placed between the panes of glass in a two-glass window and which stretch horizontally across the whole of the window from one edge of the frame to the other and which are rotatable between mainly a vertical and a horizontal position. The invention is characterized in that in the vertical position the blades form at least substantially tight walls spaced apart and forming between them an integral and substantially closed air space. To ensure that the air space is closed sufficiently to prevent any air leakage of importance through the walls in their vertical position, the edges of adjacent blades in the same wall are in accordance with the invention preferably in contact with each other.

From a constructional and operational view point, a suitable design of the venetian blind according to the invention is such that alternate blades form the inner and outer walls. Thereupon is preferably such a venetian blind so constructed that in the horizontal position the blades stretch from the vicinity of one of the glass panes to somewhat past the centerline between the glass panes. Furthermore, the closed air space between the walls may have a mainly central position between the walls and occupy approximately one-third of the space between the panes of glass.

According to the invention 8 to 12 mm is a suitable distance between the walls formed by the venetian blind to obtain the optimum heat insulation for a normal production window with two panes panes of glass.

Figure 2:
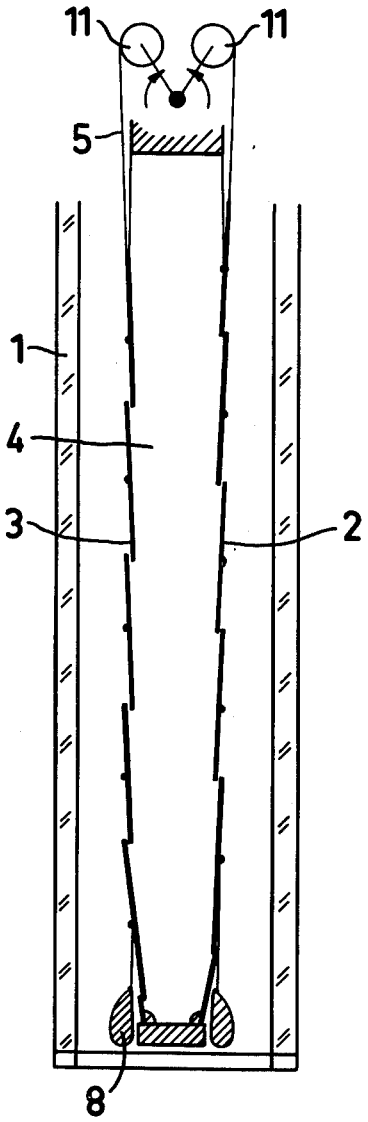

The invention is described below in various design forms and with reference to the attached drawings, in which FIG. 1 shows a preferred embodiment of the design with the blades in the open position; and FIG. 2 shows the same design as in FIG. 2 but with the blades in the closed position.

In all of the designs the venetian blind is contained between the panes of glass 1,1 in the window. Two blades 2 and 3 which are adjacent in the open position shall in the closed position become elements in the two spaced walls which form an integral air space 4. Since the blades stretch across the whole window from one side frame to the other, and because of the presence of the window frame at the top and the bottom, the air space is effectively closed. When in closed position the blades are turned to such an angle that they contact each other so that air leakage through the walls to or from the air space is negligible.

FIG. 1 shows an operable design for the venetian blind according to the invention. In this design alternate blades are connected by cords 5 attached to the outer edges of alternate blades and the alternate blades are also connected by cords 10 which are attached near the centers of the blades. The dotted arrows show how the blades change from the horizontal to the vertical position. The change in angle can, for example, be accomplished by turning upwards two arms 11, as shown in FIG. 2, whereby the closed and integral air space 4 is formed. Weight 8 holds the cords tensioned. Also with this design the blades can be adjusted to a required angle to the horizontal using rollers on arms 11 and the whole ventian blind can be made so that it can be drawn up. The inner edges of the blades have short slots cut in them (not shown) to allow the cords 10 to be free and to allow rotation of the blades. In the vertical position the slots are covered to a great extent by the extent of the overlap of the adjacent blade.

As shown in FIG. 2 the designs produce an air space 4 which occupies approximately a third of the space between the two panes of glass, and is central, between the two panes. With the usual types of windows with two panes of glass it has been shown that an optimum heat insulation effect is obtained if the space between the two walls formed by the blades is in the range 8–12 mm.

The blades may be formed of plastic, metal or any other suitable material. Thin aluminum blades appear preferable. To obtain sufficient stiffness in a blade it is preferable if the cross section of the blade is curved or bent at one point.

We claim:

1. An insulating venetian blind consisting essentially of a number of thin blades, which are provided between the panes of glass of a double glass window and stretch from the inside edge of one side frame to the other across the whole window and which are turnable between a horizontal and a vertical position, characterized in that in the vertical position the blades (2, 3) form at least mainly tight walls being spaced apart and forming between them an integral and substantially closed air space, thereby reducing heat losses through a double glass window to at least equal low heat losses as through a window with three panes of glass.

2. An insulating venetian blind according to claim 1, according to which the edges of adjacent blades (2,3) contact each other in the vertical position of the blades.

3. An insulating venetian blind according to claim 1, wherein that alternate blades (2) form one wall and the remaining blades (3) form the other wall of said air space.

4. An insulating venetian blind according to claim 3, according to which the blades (2,3) when in the horizontal position stretch from the vicinity of one of the glass panes (1) to some distance beyond the center line between the two glass panes.

5. An insulating venetian blind according to claim 3, wherein the air space (4) is generally in the center of the space between the two glass panes (1) and occupies approximately a third of the space between the two glass panes.

6. An insulating venetian blind according to claim 1, according to which the distance between the walls formed by the blades when in the vertical position is 8–12 mm.

* * * * *